United States Patent [19]

Taub

[11] Patent Number: 4,605,130

[45] Date of Patent: Aug. 12, 1986

[54] ARTICLE DISPLAY STAND WITH SELF-FEEDING HOPPER

[75] Inventor: Ronald H. Taub, Highland Park, Ill.

[73] Assignee: Taub Family Trust, Highland Park, Ill.

[21] Appl. No.: 677,978

[22] Filed: Dec. 4, 1984

[51] Int. Cl.[4] ..... A47F 5/11

[52] U.S. Cl. ..... 211/59.2; 211/72; 211/133; 248/174

[58] Field of Search ..... 211/59.2, 132, 70.2, 211/70.3, 72, 73, 133; 312/42; 248/174; 229/17 B; 222/185

[56] References Cited

U.S. PATENT DOCUMENTS

| | | | |
|---|---|---|---|
| 2,338,567 | 1/1944 | Barron | 248/174 |
| 2,713,984 | 7/1955 | Paige | 211/133 X |
| 2,785,843 | 3/1957 | Shaw | 312/42 |
| 2,797,815 | 7/1957 | Gorman | 248/174 X |
| 4,197,939 | 4/1980 | Dogliotti | 248/174 X |
| 4,530,548 | 7/1985 | Spamer et al. | 211/59.2 X |

*Primary Examiner*—Robert W. Gibson, Jr.
*Attorney, Agent, or Firm*—Esther O. Kegan

[57] ABSTRACT

A display stand for displaying articles at point-of-sale in which a one-piece upstanding base is provided with an integral article-supporting section that is pivotal about a fold line relative to one of the four walls of the base, so that the article-supporting section may alternatively be pivoted into the hollow interior of the upstanding base to provide a support for the displayed articles, and out of the hollow interior of the base to a substantially parallel position with the wall to which it is connected for subsequent folding and storage. The display stand is further provided with a storage bin connected to the upper, rear rim portion of the upstanding base and elevated above the article-supporting section, which storage bin is provided with a lower, exit mouth through which the display articles exit as the articles displayed on the article-support surface are removed. The front wall of the upstanding base projects forwardly a greater distance than the forward wall of the storage bin, so that the upper supporting surface of the article-supporting section is exposed. The upstanding base is also provided with slots for holding the article-supporting section in the hollow interior of the base, and for securing the storage bin to the rear portion of the upper rim of the base. The entire unit is capable of being disassembled into its component parts, each of which folds compactly for easy storage and shipping, and eventual re-assembly.

18 Claims, 8 Drawing Figures

ARTICLE DISPLAY STAND WITH SELF-FEEDING HOPPER

BACKGROUND OF THE INVENTION

The present invention relates to an improved floor display-stand assembly in which items at point-of-sale may be easily and readily made visible to potential customers, and which automatically feeds additional such items to the supporting surface displaying the items, as the items are removed by purchasers. The automatic and self-feeding nature of the display stand of the present invention is combined with visual effectiveness in displaying the items for sale, to aid in the notice of the items and, therefore, the sale thereof.

The present invention is part of that category of display stands that are collapsible and foldable, to allow for easy shipping and storage, but allow for fast and easy assembly for displaying items. Such display stands are shown in Taub U.S. Pat. No. 3,589,046; Taub U.S. Pat. No. 3,593,768; Taub U.S. Pat. No. 3,918,576; and Taub U.S. Pat. No. 4,274,613. The differences between the present invention and those of the prior art are considerable and advantageous.

SUMMARY OF THE INVENTION

It is a primary object of the present invention to provide a display stand that is collapsible and foldable, and will, upon assembly, allow for eye-catching displays of items to be sold at point-of-sale, and the like, and at the same time ensure that the items on sale are automatically supplied to an article-supporting surface as the items are removed by purchasers, so that the article-supporting surface always appears full of the items to be sold, and so that there is no need for frequent, continual refilling of the display stand by workers.

It is another object of the present invention to provide a self-feeding display stand for standing on a floor, in which the item to be sold by the display stand may be well-advertised on the display stand itself.

It is still another object of the present invention to provide a self-feeding floor display stand for items being sold at point-of-sale that is readily and easily disassembled into component parts for subsequent storage and re-use at a later time.

It is still another object of the present invention to provide such a collapsible and foldable floor-supported self-feeding display stand that, when collapsed and folded, will facilely fit into a cardboard box of considerably smaller size than the size of the assembled display stand.

Toward these above-ends, the self-feeding, collapsible floor-supported display stand of the present invention is made up of a support base that is self-supporting on a floor of a supermarket, store, and the like. The support base is provided with an integrally-attached article-supporting surface that is pivotal into and out of the upper hollow interior of the support base, for assembly and disassembly, respectively, of the display stand. The support base has a flap formed in its rear wall that is movable away from the planar surface of the rear wall to define a securing slot for holding, in a releasable manner, the rear edge surface of the article-supporting surface. Preferably, the article-supporting surface is supported by the securing slot such that it declines from the rear toward the front, so that items thereon are urged toward the front of the display stand.

The article-supporting surface is preferably formed integral with the front edge surface of the upper peripheral rim of the support base along a fold line, so that the article-supporting surface achieves its movement into and out of the hollow interior of the support base with little effort.

The support base itself is, also, preferably formed with fold lines along its four corner edges, in the case where the support base has a quadrilateral cross-sectional shape, and is also provided with center fold lines on the two side walls of the support base, for folding the two side walls in half, such that the four walls of the support base and the article-supporting surface all lie, when collapsed and folded, in parallel planes.

The article-supporting surface itself is made of two sections. The first section is directly joined to the front edge of upper rim of the support base, in the preferred embodiment, by a fold line, while the second section is pivotally connected to the first section via another fold line parallel to and spaced from the fold line connecting the first section to the upper forward edge of the support base. The edge of the second section remote from the first section is provided with a flap for mating engagement with the slot formed by the flap formed in the rear wall of the support base. Thus, the declivity of the article-supporting surface results when the support base is assembled for display.

In combination with the support base, there is also provided a self-feeding article-storage hopper or storage chamber in which are stored items to be displayed on the article-supporting surface. The self-feeding hopper or storage chamber is also a collapsible and foldable unit, which, in the preferred form of the invention, is preferably quadrilateral in cross-section when unfolded and assembled. The hopper is releasably securable to the rear portions of the upper peripheral edge rim of the support base by tenons projecting downwardly from the lower edge surface of the hopper, which tenons fit into slots formed in the rear upper peripheral edge surface of the support base. In the preferred embodiment, two spaced slots are provided in the upper edge surface of the rear wall, which slots are formed by disjoined, spaced portions of a rear flap connected along most of its length along a fold line to the upper edge surface of the rear wall.

The storage hopper or chamber is also releasably secured to the upper peripheral rim of the support base by a pair of side tenons extending downwardly from the lower edge surface of the two side walls of the storage chamber. The support base is provided with side flaps disjoined at portions thereof from connection to the upper edge surfaces of the side walls, to define slots for matingly receiving the side tenons. Thus, the storage hopper is easily and readily affixable to and removable from the upper peripheral edge surface of the support base, for assembly or storage, respectively.

The storage hopper is positionable above the article-supporting surface when the display stand is assembled, so that items stored in the hopper fall through a lower exit mouth directly onto the upper surface of the article-supporting surface. Such feeding of the items from the hopper continues until the items displayed on the upper surface of the article-supporting surface are sufficient enough to hold back further exiting of stored items through the exit mouth, which occurs when no more of the items can descend along the decline defined by the downwardly-sloping article-supporting surface.

While in the preferred embodiment, each of the support base, article-supporting surface, and storage hopper has been indicated as being quadrilateral in cross-section, the present invention may be used for cross-sections of any polygonal shape, and may even be used for cross-sections of circular shape.

BRIEF DESCRIPTION OF THE DRAWING

The invention will be more readily understood with reference to the accompanying drawing, wherein.

DETAILED DESCRIPTION OF THE INVENTION

Figure 1:
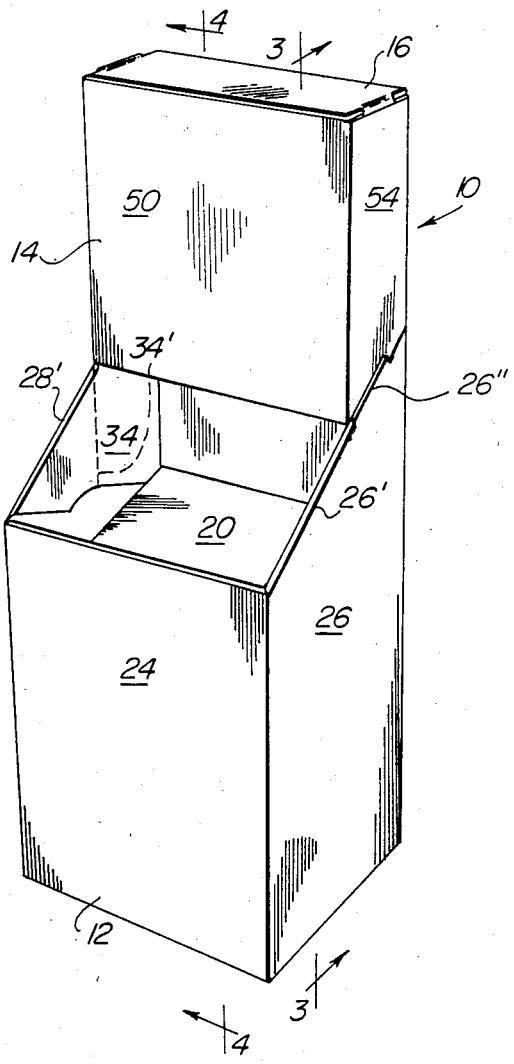
FIG. 1 is a perspective view showing the novel display stand of the present invention in its assembled, floor-supported and upright position.
Figure 2:
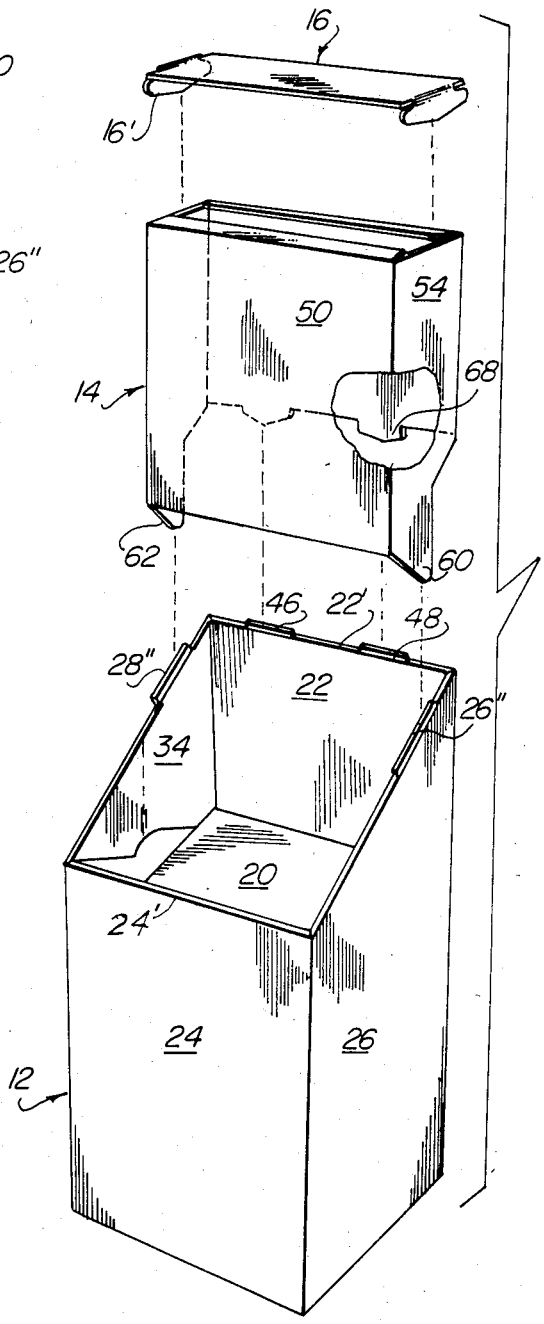
FIG. 2 is an assembly view, in perspective, showing the novel display stand of FIG. 1 as it is being assembled.

Referring now to the drawing in greater detail, the novel collapsible and foldable display stand of the present invention is indicated generally by reference numeral 10 in FIG. 1. As shown in FIGS. 1 and 2, the novel display stand 10 is made up of substantially three separate component parts: the support base 12; the storage chamber or hopper 14; and the storage hopper cover lid 16. Each of these three component parts is collapsible and foldable about appropriately-provided fold lines, to be described below in greater detail. As can be seen in FIG. 1, when assembled, the novel display stand of the present invention is so arranged that the support base 12 is supported upright upon a floor where items are to be displayed. The storage chamber or hopper 14 is releasably affixed to the upper rim of the support base, such that the hopper 14 is positioned directly above and over an article-supporting surface 20, which, in the preferred embodiment, is formed integrally with the support base 12. This article-supporting surface 20 preferably slopes downwardly from the rear of the display stand 10 toward the front, so that any items on display thereon are urged toward the front of the display. This will ensure that the same items stored in the hopper 14 will drop through the lower exit mouth or opening formed in the bottom of the storage hopper 14 directly onto the article-supporting surface 20 as the items on the article-supporting surface become depleted, as purchasers of the items remove them from the stand. Thus, there is provided a continual and automatic re-filling of the displayed items on the article-supporting surface 20, so that the display stand always appears to be full of the items for display, and so that continual, repetitive manual re-filling of the items on the article-supporting surface is obviated.

Figure 4:
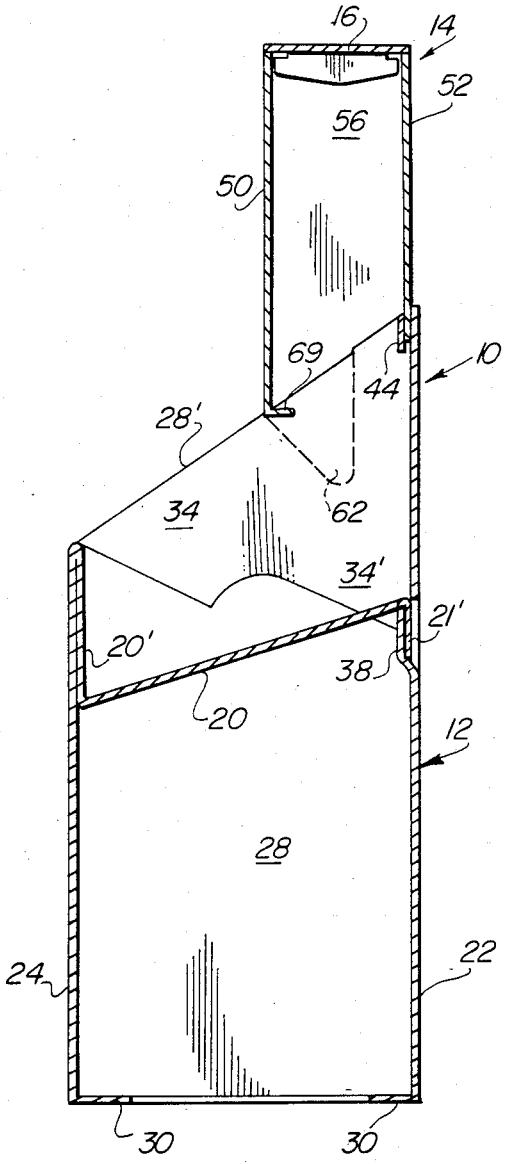
FIG. 4 is a cross-sectional view taken along line 4—4 of FIG. 1.

The support base 12 is generally of a quadrilateral-shaped cross-section, and has a rear wall 22, front wall 24, a first side wall 26, and a second side wall 28. The support base 12 has a hollow interior and an open bottom 12' defined by foot flaps 30, as shown in FIG. 4. The foot flaps 30 provide stability to the stand when it is assembled and floor-supported in an upright manner. The foot flaps are connected to the lower edges of the respective walls by fold lines for folding the flaps 30 during storage and shipping, as explained below.

Each side wall 26 and 28 is provided with a center fold line extending the entire height of the respective side wall for folding the side walls, such that the entire support base 12 may be collapsed and folded for storing. When folded, the four walls overlie each other, with half of each side wall being superimposed over the other half of the same side wall, in a manner disclosed in U.S. Pat. No. 3,918,576.

It can be seen in the drawing, that the rear wall 22 is of a greater height than the front wall 24, so that each of the side walls 26 and 28 slope upwardly at its upper edge 26' and 28', respectively, from the front wall toward the rear wall. Along with the upper edge surfaces 22' and 24' of the rear wall and front wall, respectively, these upper edges 26' and 28' define an upper peripheral edge surface of the support base, which upper peripheral edge surface is used to mount the storage hopper or chamber 14 to the support base. Toward this end, each side wall 26 and 28 is provided with a side flap 32 and 34, respectively, each flap 32, 34 being connected to the upper edge surface of its respective side wall along a fold line. Adjacent the rear portion of the upper edge surface of each side wall, a portion of the respective side flap is left unattached, or disjoined, relative to the upper edge surface of the respective side wall, to thus define a slotted opening in which is received a tenon, or tongue, extending from the lower side edge surface of the storage hopper, to be described below, for mounting the storage hopper to the support base. The slots in the side walls 26 and 28 may be seen in FIG. 2, and are indicated by reference numerals 26'' and 28'', which are at the disjoined portions of the fold lines connecting the edge surfaces of the side flaps to the upper edge surfaces of the side walls. Each side flap 32 and 34 is also provided with a center fold line extending the height of the flap at the portion thereof coiniciding with the center fold line of its respective side wall, so that the two fold lines extend parallel to each other and coextensively along the mid-portion of the side walls, so that when the support base is collapsed and folded, each of flaps 32 and 34 is also folded about its center fold line in superimposed relationship over the two portions of its respective side walls. The height, also, of each side flap 32 and 34 is such that it lends structural integrity to the support base 12, the height of each side flap being greater toward the rear wall, as indicated by reference numberal 34' in FIG. 4. The greater height at the rear of the side flaps is provided, among other reasons, since the storage hopper 14 is mounted thereabove, causing greater structural need toward the rear of the support base than the front thereof. The greater heights of the rear portions of the side flaps also help to initially set up the support base 12 before the article-supporting surface 20 has been pivoted into the interior of the support base. This is achieved by preventing buckling of the walls, which would tend to occur, owing to the tendency of the walls to assume their folded configuration in which they had been stored for a lengthy period of time.

Figure 6:
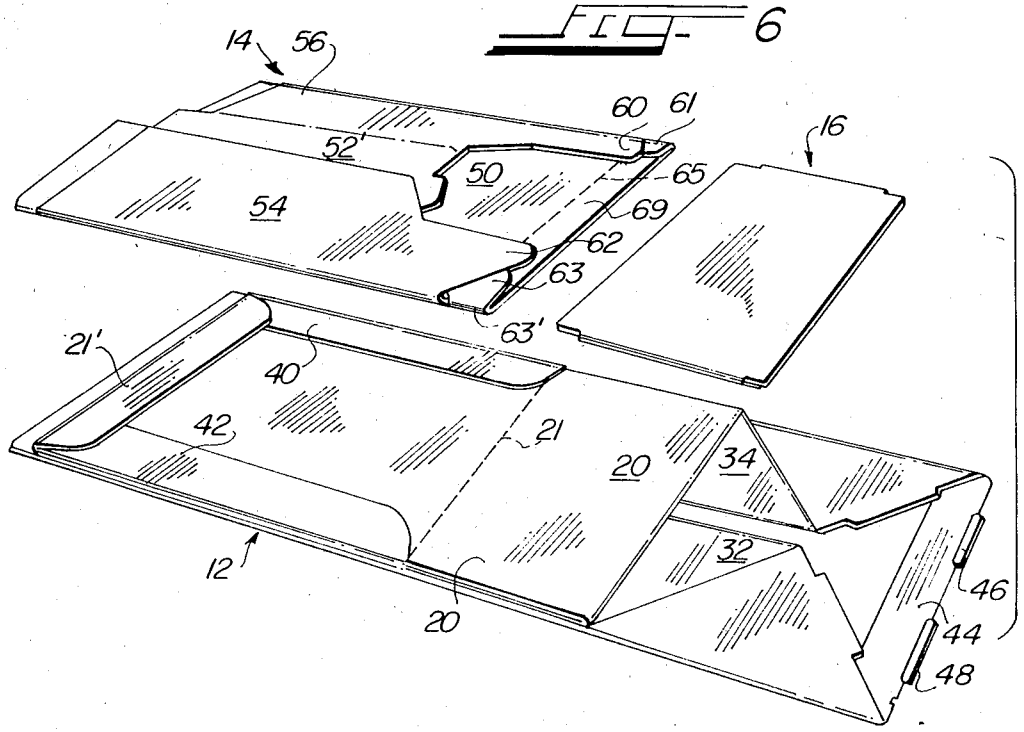
FIG. 6 is an assembly view showing the component parts of the present invention in their collapsed, folded configurations ready for superimposed relationship, for packing into a box, for subsequent storage and shipping.

In the preferred form of the invention, the article-supporting surface 20 is formed integrally with the front wall 24 via forward flap 20′ shown in FIGS. 4 and 6. The forward flap 20′ is connected by a fold line at an edge surface thereof to the upper edge surface of the front wall 24, so that the article-supporting surface 20 is pivotal into and out of the hollow interior of the support base 12. FIG. 4 shows this article-supporting surface 20 in the upper hollow interior of the support base for use in supporting thereon items on display, while FIG. 6 shows this article-supporting surface out of the hollow interior in superimposed, parallel relationship with the outer surface of the front wall 24 for storage. In FIG. 6, it can be seen that the forward flap 20′ is connected to the remainder of the article-supporting surface 20 via another fold line 21 parallel to the fold line connecting the edge of the article-supporting surface to the upper edge surface of the front wall 24. This fold line 21 allows positioning of the article-supporting surface 20 in the hollow interior of the support base 12 in an inclined, upwardly-sloping manner, taken from front to rear, as can be seen in FIG. 4.

Figure 3:
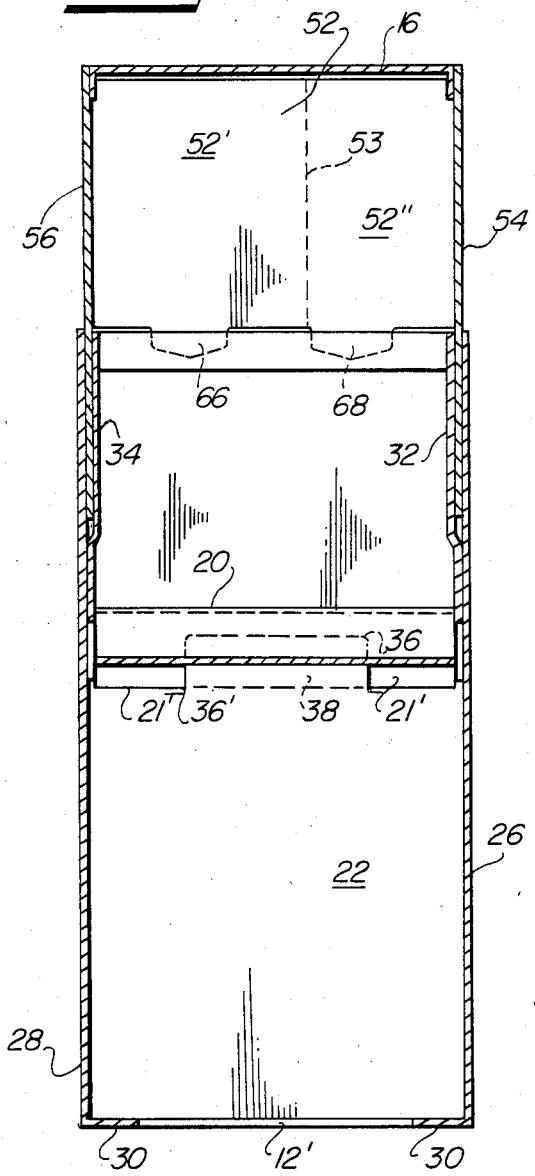
FIG. 3 is a cross-sectional view taken along line 3—3 of FIG. 1.

The inner surface of the rear wall 22 is provided with an elongated, approximately U-shaped cut 36, shown in FIG. 3, so as to delimit a retaining space for a rear flap 21′ of the article-supporting surface. This retaining space is achieved by slightly pivoting forward rear wall portion 38, so that the rear flap 21′ can slide downwardly in back of the rear wall portion 38 and be held therein. The length of the rear flap 21′, as can be seen in FIG. 3, is substantially the length of the rear wall 22. Preferably, at least the bottom of cut 36 made in the rear wall 22 lies above the horizontal plane containing therein the fold line 21 connecting the two portions of the article-supporting surface together. This ensures that the article-supporting surface 20 slopes upwardly a desired degree from front to rear when the display stand is assembled and placed upright, and when the article-supporting surface 20 is pivoted into the hollow interior of the support base 12. Of course, the angle of incline of the surface 20 may be changed to suit varying needs, so that the cut 36 may be placed in the rear wall at a location suitable to the angle of incline so desired. This incline ensures that the items on display and supported on the surface 20 will tend downwardly toward the front wall 24 and be stopped there by abutment against the inner surface of the forward flap 20′, which, thus, constitutes a front retaining wall for the displayed items. This sloping article-supporting surface 20 also ensures that, since the items on display are urged toward the front retaining wall, those items stored in the storage chamber 14 will tend to fall through the lower exit opening thereof as the items on display fall toward the front of the article-supporting surface 20, thus refilling the items on display on the surface 20. It is noted that lower side slits 36′ are formed on either end of the U-shaped cut 36, as shown in FIG. 3, in order to aid in the interior pivoting of the wall portion 38 for reception of the rear flap 21′. The article-supporting surface 20 is also provided with a pair of end flaps 40 and 42, as shown in FIG. 6. It is noted that rear portion 34′ of each side flap 32 and 34 is of such a height as to be tucked tight, in sandwich-like fashion, between a rear portion of a respective end flap 40, 42 and a respective side wall 26, 28, in order to prevent movement of the side flaps 32 and 34 during normal display.

The rear wall 22 of the support base is also provided with a flap portion 44, as shown in FIGS. 4 and 6, which flap portion is connected along most of its length to the upper edge surface of the rear wall by a fold line, so that the flap portion 44 may be pivoted into the hollow interior of the support base. The flap portion 44 and the upper edge surface 22′ of the rear wall are disjoined along two spaced-apart portions 46 and 48 in order to define a pair of spaced, slotted openings 46 and 48, which receive therein a pair of tenons projecting from the lower edge surface of the rear wall of the storage chamber 14, to mount the rear wall of the storage chamber to the support base, in a manner similar to the use of the slotted openings 26″ and 28″.

The storage chamber 14 is a generally box-shaped element having a quadrilateral-shaped cross-section, which defines a hollow interior, in which are stored items to be displayed on the article-supporting surface 20. The storage chamber 14 has a front wall 50, rear wall 52, a first side wall 54, and a second side wall 56. The rear wall 52 has a lesser height than the front wall 50, so that the lower edge surfaces of each of the side walls 54 and 56 slope downwardly from the rear wall to the front wall, as can be seen in FIG. 2. The angle of slope of each of the lower edges of the side walls is equal to the same angle of slope as each of the upper edge surfaces 26′ and 28′ of each of the side walls 26 and 28, respectively, of the support base 12, so that the side walls of the storage chamber match the side walls of the support base. Extending downwardly from each lower edge surface of the side walls 54 and 56 is a tenon, or tongue element, 60 and 62, respectively. Each tenon 60, 62 projects at right angles to its respective canted lower edge surface, so that it may project directly into a corresponding slot 26″, 28″, respectively. Each tenon 60 and 62 preferably tapers such that it becomes narrower from its base connected to the lower edge surface of its respective side wall, to its tip spaced from the lower edge surface of its respective side wall, thus aiding in the emplacement of the tenons in the slots 26″ and 28″. The greatest span of each tenon, which is the base thereof connected to the lower edge surface of its respective side wall, is less than the length of its respective slot 26″, 28″.

The rear wall 52 also has a pair of tenons 66 and 68 for sliding into the slot openings 46 and 48, respectively, in the upper edge surface of the rear wall 22 of the support base 12. Each tenon 66 and 68 is also preferably slightly tapered. The rear wall 52 is provided with a sectional fold line 53, shown in FIG. 3, extending the entire height of the rear wall for collapsing the storage chamber for subsequent folding and storage. As shown in FIG. 3, this fold line of the rear wall of the storage chamber divides the rear wall into two unequal sections 52′ and 52″, with the length of one section 52″ being equal to the width of a side wall, so that when the storage chamber is folded, and the rear wall is folded about fold line 53, the two side walls 54 and 56 are superimposed over the front wall 50, where one of the superimposed side walls 56 lies directly against the rear surface of the front wall 50, and where the other of the side walls 54 overlies the folded-over section 52″ of the rear wall. The length of section 52′ along with the width of the side wall 54 together equal the length of front wall 50. The second section 52" (not seen in FIG. 6) is equal in length to the width of side wall 56, shown folded over this second section 52" in FIG. 6.

The storage hopper 14 is also provided with lower flap 69 formed along the lower edge surface of the front wall 50, and connected thereto via a fold line 65. This flap 69 defines the forward wall portion of the lower exit mouth of the storage chamber through which the stored items descend onto the article-supporting surface 20. This lower flat 69 is pivoted about fold line 65 such that when the hopper 14 is mounted to the support base, the flap 69 is positioned approximately perpendicular to the front wall 50, as shown in FIG. 4. At each end of the flap 69, there is provided an end tenon 61 and 63. Each end tenon is pivotal relative to the flap 69 via a fold line, such as fold line 63' shown in FIG. 6. During storage and shipping the end tenons 61 and 63 are superimposed over the interior end portions of the flap 69, in the manner shown in FIG. 6. However, upon mounting the hopper to the support base via the slots of the support base, the flap 69 is pivoted approximately ninety degrees about fold line 65 in the counter-clockwise direction, when viewing FIG. 6, after the tenons 60 and 62 have been pivoted out of the way for mounting the hopper to the support base via the slots 26", 28". After the flap 69 has been rotated about the fold line 65, each of the end tenons 61 and 63 is pivoted, such that each projects approximately in a plane parallel to its respective slot 26", 28" for subsequent forced insertion into the slots. These end tenons hold the lower flap 69 firmly in place, so as to prevent buckling of the storage hopper 14. Each end tenon 61 and 63 is preferably tapered as shown in FIG. 6. Each slot 26" and 28" is of such length as to accommodate therein a respective tandem of tenons 60 and 61, or 62 and 63, with an end tenon 61 and 63 being received in the forward-most portion of a respective slot. As can be seen in FIG. 6, the tenons 62 and 63, and the tenons 60 and 61, have matching canted surfaces, which complement each other with positioned in their respective slots.

Figure 5:
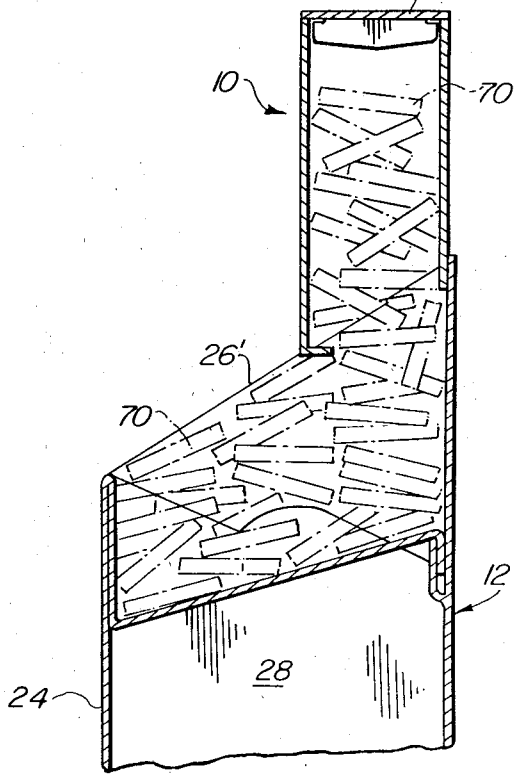
FIG. 5 is a partial cross-sectional side view showing the storage hopper, or chamber, filled with items displayed upon the article-supporting surface positioned directly below the storage chamber.

FIG. 5 shows the novel display stand of the present invention in its erected position, wtih the storage chamber filled with items 70 for display. As can be seen, when the items 70 are removed by purchasers from the forward or rear portions of the article-supporting surface 20, the vacated spaces are filled by those items rearward of the vacated spaces, until finally the rearward-most vacated spaces are replenished with items falling from the exit opening of the storage chamber itself.

A cover lid 16 is also provided for closing off the open top portion of the storage hopper, which cover lid is provided with end flaps 16' for guiding the cover portion into the top of the storage hopper, in a manner shown in FIG. 2. The end flaps 16' are connected to the main body of the top cover portion also by fold lines.

It is pointed out that width of each side wall 54 and 56 of the storage hopper 14 is substantially less than the width of the side walls 26 and 28 of the support base 12, so as to leave unobstructed from view approximately the forward half of the article-supporting surface 20. This forward half of the article-supporting surface is that part generally visible to passers-by, so that the items supported thereon catch the eye of a potential purchaser.

Figure 7:
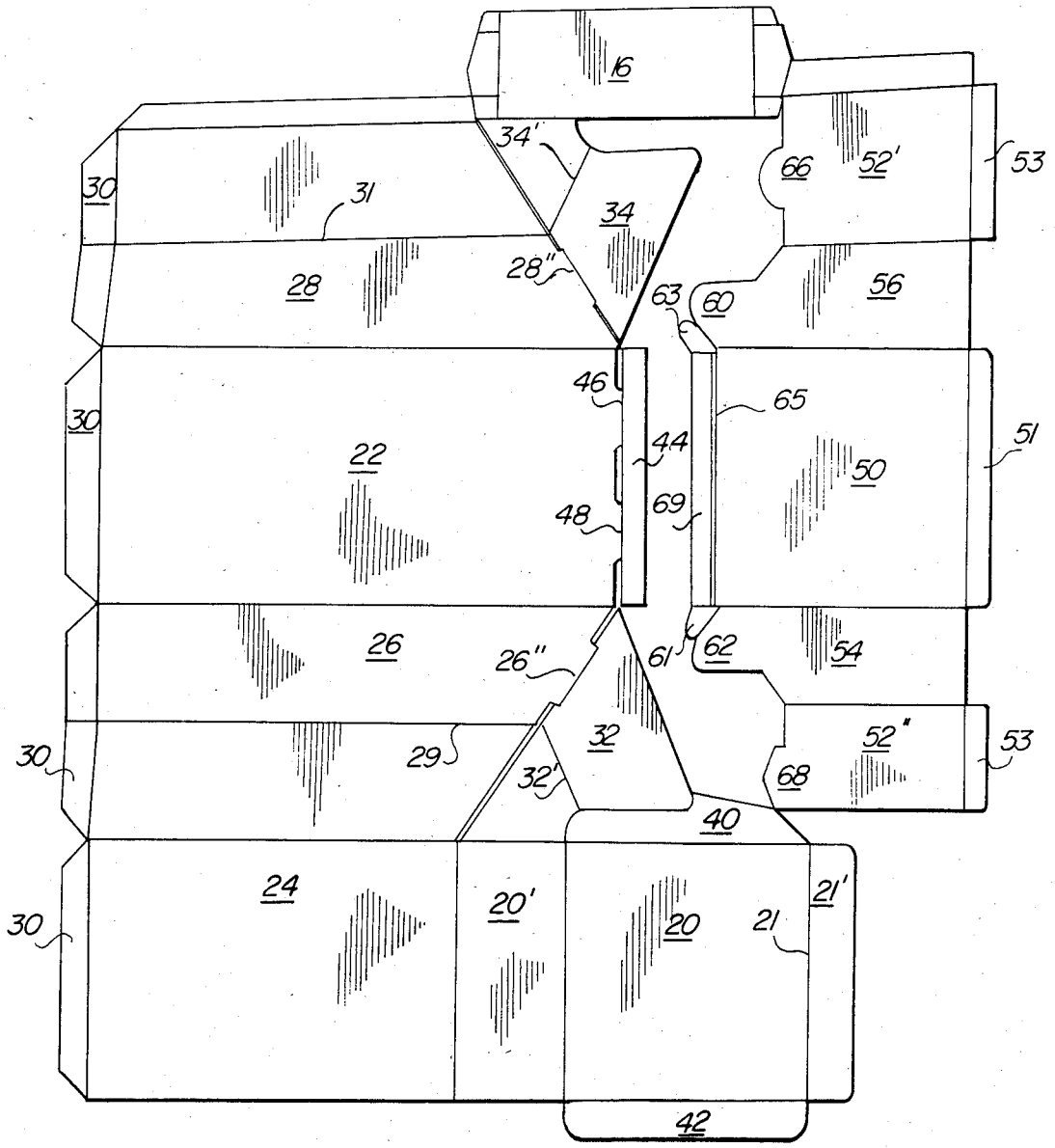
FIG. 7 is a schematic view showing the formation of each of the parts of the display stand of the present invention from one piece of cardboard, corrugated board, or the like for subsequent cutting and folding.
Figure 8:
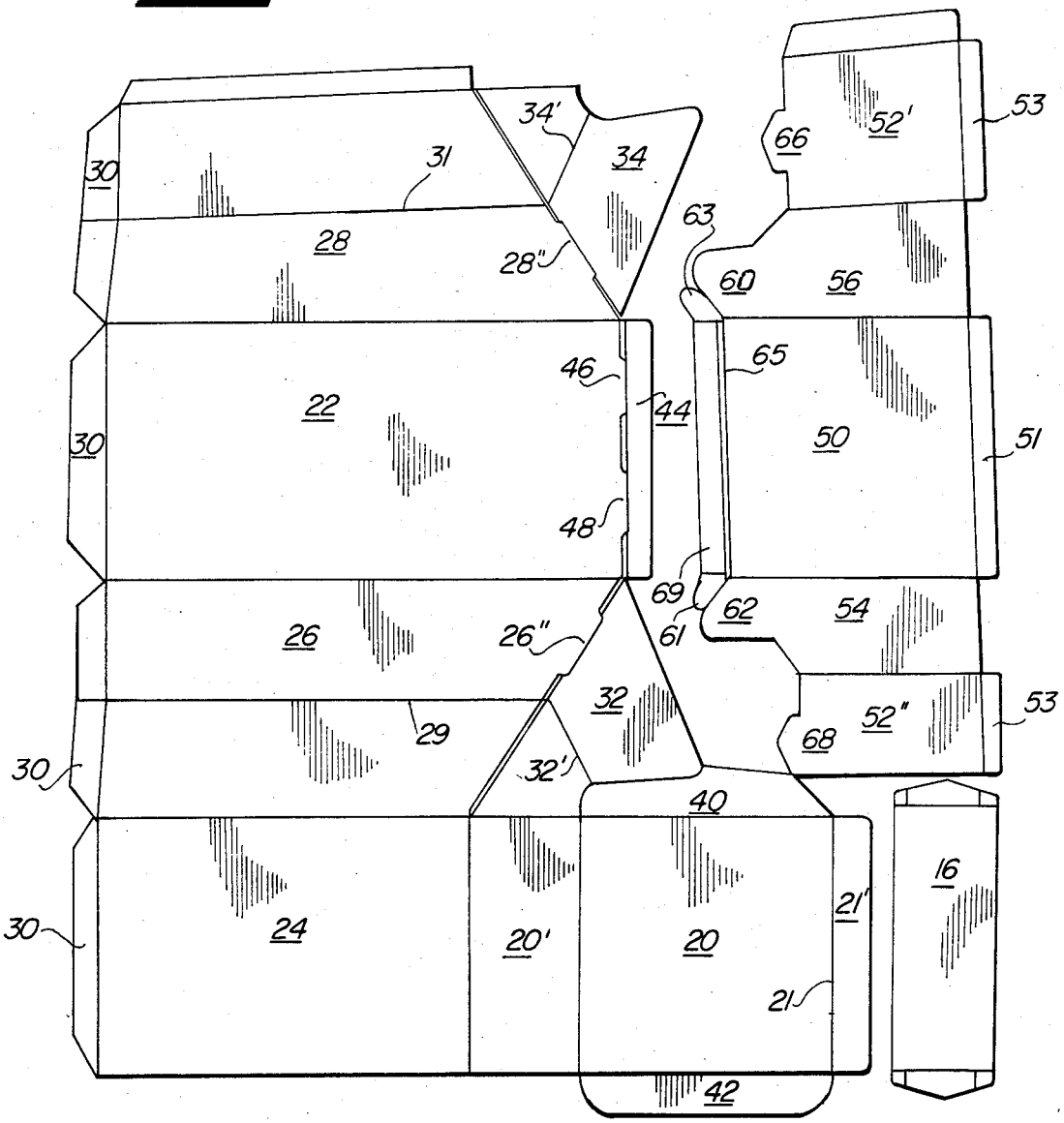
FIG. 8 is a schematic view similar to FIG. 7 showing another pattern of creating the parts of the display stand of the present invention from one piece of material.

In FIGS. 7 and 8, there are shown two different ways of creating the components of the display stand of the present invention from one integrated piece of cardboard, corrugated board, or the like. The reference numerals shown in these figures refer to the parts described in FIGS. 1 through 6. These figures are self-evident as to how the display stand parts of the present invention are subsequently formed. Sodid lines between parts in FIGS. 7 and 8 indicate fold lines. The boundary between elements 32 and 40 is cut therealong to form these elements shown in Figures 1 through 6. Fold lines 32' and 34' devide the side flaps 32 and 34 for subsequent folding, when the support base 12 is collapsed and folded, and described above in greater detail. These fold lines 34' and 36' correspond with the fold lines 29 and 31 in the side walls of the support base when the support base is erected, so that they may be folded together in unison, as described above. The difference between FIG. 7 and FIG. 8 is the portion of the onepiece board from which the top cover portion 16 is formed. In FIG. 7, this top cover portion 16 is formed at the top of the one-piece board between the side wall 28 of the support base and the rear wall portion 52' of the storage chamber. In FIG. 8, this top cover portion 16 is formed at the bottom of the material, directly adjacent to the flap 21' of the article-supporting surface 20.

While a specific embodiment of the invention has been shown and described, it is to be understood that numerous changes and modifications thereof may be made without departing from the scope, spirit, and intent of the invention as set out in the appended claims. While it has been described in the preferred embodiment of the invention that each of the component parts of the display stand is of a quadrilateral-cross section, other polygonal-shaped cross-sections may be employed, such as triangular. Further, the slope of the article-supporting surface may be varied, and it is within the scope of the present invention to provide a horizontal aritcle-supporting surface 20. Further, such article-supporting surface need not be made integrally with the support base 12, but may be a separate and independenet component of the display stand of the present invention, which is foldable by itself and positionable in the upper hollow interior of the support base via the same cut 38 in th rear wall of the support base, along with a similar cut made in the front wall 24 of the support base 12, so that the front and rear of the article-supporting surface are supported in the same manner as that illustrated in FIG. 4 for the rear flap 21'. In this case, the article-supporting surface is provided with a front flap similar to rear flap 21'.

I claim:

1. A display stand for displaying articles for sale, comprising:

an upstanding support base portion of substantially hollow construction having a plurality of walls thereof defining a hollow interior, said support base portion being formed from one piece of material, such as corrugated board, paperboard, and the like, and having an integrally-formed article-supporting section for supporting thereon articles to be displayed; said article-supporting section being pivotally connected along a fold line to a rim portion of one of said walls, whereby said article-supporting section may alternatively be swung into the hollow interior of said upstanding support base portion for use as a display stand upon which are supported articles to be displayed, and swung out of the interior of said upstanding support base portion to position said article-supporting section substantially parallel to said one wall to which it is connected;

said upstanding support base portion firmly and releasably holding said article-supporting section in the hollow interior of said upstanding support base portion when said section is positioned therein; whereby said article-supporting section may be fixed in the interior of said upstanding support base portion for displaying articles, and pivoted out of the interior for subsequent folding and storage;

a storage bin having a hollow interior in which are stored articles to be displayed on said article-supporting section, said storage bin being mounted substantially vertically to the upper portion of at least one of said plurality of walls for projection above the top of said upstanding support base portion; said storage bin having a lower exit mouth through which the stored articles exit and drop onto said article-supporting section;

said storage bin, said article-supporting surface, and said support base portion all being made from one piece of material.

2. The display stand according to claim 1, wherein said support base portion comprises means for releasably securing said article-supporting section in the hollow interior of said support base portion, said means comprising means on at least one of said plurality of walls for positioning said article-supporting section at an angle relative to a horizontal plane, such that said article-supporting section provides a downwardly sloping surface to cause the articles stored thereon to descend toward the front of said supporting base portion.

3. The display stand according to claim 1, wherein said support base portion comprises a first side wall, a second side wall, a front wall, and a rear wall, and said exit mouth has a length substantially the same as the length of said article-supporting section, said length of said article-supporting section being taken in a direction from said first side wall of said support base portion to said second side wall thereof, so that said exit mouth extends across said article-supporting section substantially from said first side wall to said second side wall of said support base portion.

4. The display stand according to claim 3, wherein said storage bin comprises a front wall section, said front wall section being offset from said front wall of said support base portion such that said front wall of said support base projects a greater forward distance than said front wall section, so that the top supporting surface of said article-supporting section is visible to display the articles.

5. A stand for displaying items at point-of-sale, and the like, comprising, in combination:

an upright supporting frame having an upper article-supporting surface upon which items to be displayed are placed;

said upright supporting frame having an upper, peripheral rim extending about the circumference of said article-supporting surface;

an article-storage chamber having a substantially hollow interior for storing therein items to be displayed on said article-supporting surface of said supporting frame; said article-storage chamber having appropriately-placed fold line means for collapsing said article-storage chamber into a folded, flat compact storing and shipping configuration;

said article-storage chamber having a lower, peripheral rim defining a lower-exit opening through which the items stored therein exit to said article-supporting surface of said upright supporting frame; said article-storage chamber having a width of less expanse than the width of said article-supporting surface so that items on said article-supporting surface may be viewed thereon;

said lower, peripheral rim of said article-storage chamber having means for detachably securing said article-storage chamber to an upper portion of said upright supporting frame; said upper portion having cooperating means for receiving said means for detachably securing to thereby hold said article-storage chamber to said upper portion of said upright, supporting frame, such that said article-storage chamber extends substantially perpendicularly upward from said upper peripheral rim of said supporting frame;

said lower exit opening comprising a bottom flap pivotally connected to a portion of said lower, peripheral rim via a fold line, and means for holding said bottom flap in a desired orientation relative to said lower peripheral rim to give structural integrity to said storage chamber, said means for holding also being received by said cooperating means of said upper portion.

6. The stand for displaying according to claim 5, wherein said means for detachably securing comprises a plurality of downwardly-extending tenons projecting from spaced portions of said lower peripheral rim; and said cooperating means comprises a plurality of cooperating slots formed in spaced corresonding portions of said upper portion of said upright supportng frame; and said means for holding comprises a pair of end tongues, each said end tongue being pivotally connected at an end edge of said bottom flap along a fold line, such that each said end tongue may be rotated to position each said end tongue in a respective one of said plurality of cooperating slots.

7. The stand according to claim 6, wherein said upright supporting frame has a substantially quadrilateral cross-sectional shape defining a rear wall, a front wall, a first side wall, and a second side wall; and said article-storage chamber also comprising a quadrilateral cross-sectional shape defining a rear wall, a front wall, a first side wall, and a second side wall; said plurality of tenons projecting downwardly from portions of said rear wall and said first and second side walls of said article-storage chamber; said plurality of slots in said upper portion being formed in portions of the upper edge surfaces of said rear wall and said first and second side walls of said upright supporting frame, whereby said article-storage chamber is detachably secured to the supporting frame for easy removal therefrom for subsequent folding, storing and shipping.

8. The stand for displaying according to claim 7, wherein said appropriately-placed fold line means comprises an intermediate fold line formed in said rear wall of said article-storage chamber, said intermediate fold line extending parallel to the planes containing therein said first and second side walls of said article-storage chamber, said fold line being vertically-oriented when said article-storage chamber is mounted to said supporting frame for displaying items.

9. The stand according to claim 8, wherein said intermediate fold line divides said rear wall of said article-storage chamber into a first section and an adjacent second section; said first section having a length substantially equal to the width of the one of said first and second side walls of said article-storage chamber closest to said first section; said fold line means further comprising additional fold lines constituting the corner edges of said quadrilateral cross-sectional shaped chamber.

10. An article-storage chamber for storing items for subsequent exiting to a support surface positioned therebelow, comprising:

a rear wall section, a front wall section, a first side wall section, a second side wall section, said first and second side wall sections being joined to the edges of said rear wall section and said front wall section at opposite ends of said rear wall and front wall section, respectively, to define a substantially hollow interior volume bounded by said wall sections;

a plurality of corner edge fold lines interconnecting said wall sections together such that each said wall section is pivotal at each edge surface relative to the wall section to which it is connected, so that all of said wall sections may be collapsed and folded for storing, shipping, and the like; and a rear fold line formed along the height of said rear wall section such that said rear fold line extends parallel to the planes containing therein said first and second side wall sections; said rear fold line partitioning said rear wall section into a first portion and a second portion directly adjacent said first portion, so that said first and second portions may pivot relative to each other along said rear fold line;

said rear fold line dividing said rear wall section such that said first portion has a length approximately equal to the width of one of the side wall sections directly adjacent and connected to said first portion, said length being taken in a direction from said first side wall section to said second side wall section, and said width of said one side wall section being taken in a direction from said front wall section to said rear wall section when said chamber is unfolded, up-standing, and ready for use, so that when said chamber is collapsed and folded for storing and shipping along said fold lines, said one side wall section overlaps said first portion of said rear wall section, so that said rear wall section, said front wall section, said first side wall section, and said second side wall section all lie in overlapping relationship in parallel planes joined by said fold lines.

11. The article-storage chamber according to claim 10, wherein the width of each of said first and second side wall section is substantially less than the length of each of said front and rear wall sections.

12. The article-storage chamber according to claim 10, in combination with a top cover portion for closing off the upper part of said hollow interior volume; said top cover portion having a length substantially equal to the length of each of said rear and front wall sections, and comprising a pair of end flaps for positioning said top cover portion in said upper part of said hollow interior volume; said top cover portion being a separate and distinct element readily detachable from said wall sections, to allow easy refilling of said hollow interior volume with articles on display.

13. A support base for a use in forming a display stand for displaying items to be sold, and the like, which support base supports at the upper peripheral rim portion thereof a self-feeding article-storage receptacle, so that the articles contained in the receptacle fall automatically onto an article-supporting surface positioned in the upper portion of the support base as the articles on the article-supporting surface are removed at point-of-sale, or the like, said support base comprising:

an upstanding frame having a lower portion for standing said frame upright, and an upper peripheral edge rim portion;

said upstanding frame comprising a first side wall and a second side wall each of said first and second side walls having an upper edge portion constituting a portion of said upper peripheral rim portion;

a first side flap portion and a second side flap portion, each of said flap portions being pivotally connected along most of its lower edge length to a respective upper edge surface of one of said first and second side walls, such that a slot is formed at the portion of each said side flap not connected to the respective said one side wall;

each of said side flaps being pivotal into the upper interior of said upstanding frame for overlapping, side-by-side parallel relationships with said one respective side wall, so that said slot of each said flap portion is exposed for entry therein of a mating element for securing an element having the mating elements thereon to said upstanding frame.

14. The support base according to claim 13, wherein said upstanding frame is made from one piece of material, such as cardboard, corrugated board, paperboard, and the like, each of said first and second side flap portions being made of the same material as said upstanding frame and being formed integral therewith.

15. The support base according to claim 13, wherein said upstanding base has a quadrilateral cross-sectional shape when unfolded to define a rear wall, a front wall, and said first and second side walls; said rear wall comprising a rear flap portion pivotally connected thereto for movement into and out of the upper hollow interior of said upstanding frame; said a rear flap portion being connected to the upper edge of said rear wall along most of the length thereof, so as to define at least one non-connected portion forming at least one slot when said rear flap portion is positioned in the upper interior of said upstanding frame in juxtaposed, overlapping relationship with said rear wall; said at least one slot of said rear wall defining an opening in which is received a mating element for mounting a member having the mating element thereof.

16. The support base according to claim 13, further comprising an article-supporting surface positionable in the upper hollow interior of said upstanding frame, said frame having means for securing said article-supporting surface in said upper hollow interior; each of said first and second side flaps having a height such that when said article-supporting surface is positioned and secured in said upper hollow interior of said frame, said article-supporting surface contacts the lower portions of said side flap portions to prevent movement thereof, to thereby hold said side flap portions in said side-by-side parallel relationships with their respective side walls.

17. The support base according to claim 16, wherein each of said flap portions is pivotally connected to said upper peripheral rim portion of said upstanding frame by a fold line joining the bottom edge surface of a respective said flap portion to the upper edge surface of its respective said wall to which it is joined.

18. A method of setting up a display stand, which display stand includes an upstanding supporting base having a rear portion, a front portion, a first side portion, and a second side portion, where the side portions interconnect opposite side edges of the front and rear portions of the supporting base; an article-supporting surface positionable in the upper portion of the supporting base upon which are supported items to be displayed for sale, or the like; and a storage bin upstanding from the upper surface of the supporting base, each of the supporting base and the storage bin being collapsible and foldable along appropriately-placed fold lines for storing, shipping, and the like; said method comprising the steps of:

(a) unfolding the supporting base along the fold lines thereof, such that each wall thereof extends upright and substantially at an angle relative to the two adjoining walls to which it is connected at each side edge surface thereof;

(b) positioning the article-supporting surface in the upper portion of the interior of the supporting base such that the article-supporting surface is held firmly therein;

(c) unfolding the storage bin along the fold lines thereof, such that the storage bin has each wall thereof extending at an angle relative to the two adjoining walls to which it is connected at each side edge surface thereof, so that the storage bin is open with its lower exit mouth facing downwardly;

(d) releasably attaching rear portions of the lower surface of the storage bin to rear portions of the upper surface of the supporting base such that the lower exit mouth of the storage bin lies directly above a rear portion of the article-supporting surface positioned in the upper portion of the supporting base, and so that a front portion of the article-supporting surface does not lie beneath any portion of the storage bin; and (e) releasably attaching opposite side portions of the lower surface of the storage bin to opposite rear side portions of the upper surface of the supporting base, so that the storage bin is releasably secured to the supporting base at portions of its rear wall and two side walls.

* * * * *